United States Patent [19]

DeBin

[11] Patent Number: 4,798,576

[45] Date of Patent: Jan. 17, 1989

[54] BAG MAKING MACHINE

[75] Inventor: Rene F. DeBin, Aalst, Belgium

[73] Assignee: FMC Corporation, Chicago, Ill.

[21] Appl. No.: 45,955

[22] Filed: May 1, 1987

[51] Int. Cl.[4] ..... B31B 23/02

[52] U.S. Cl. ..... 493/196; 493/193; 493/204; 226/114; 226/117; 242/75.3

[58] Field of Search ..... 493/24, 29, 193, 196, 493/204; 226/113, 114, 117; 242/75.3

[56] References Cited

U.S. PATENT DOCUMENTS 4,702,731 10/1987 Lambrecht et al. ..... 493/196

*Primary Examiner*—Frederick R. Schmidt
*Assistant Examiner*—William E. Terrell
*Attorney, Agent, or Firm*—Raymond E. Parks; Douglas W. Rudy; Richard B. Megley

[57] ABSTRACT

A bag making machine having a combination of a first dancer with multiple-rolls and a second dancer with a single roll for accumulating a web of flattened tubular thermoplastic material between constant and intermittent web feed sections of the bag making machine.

1 Claim, 1 Drawing Sheet

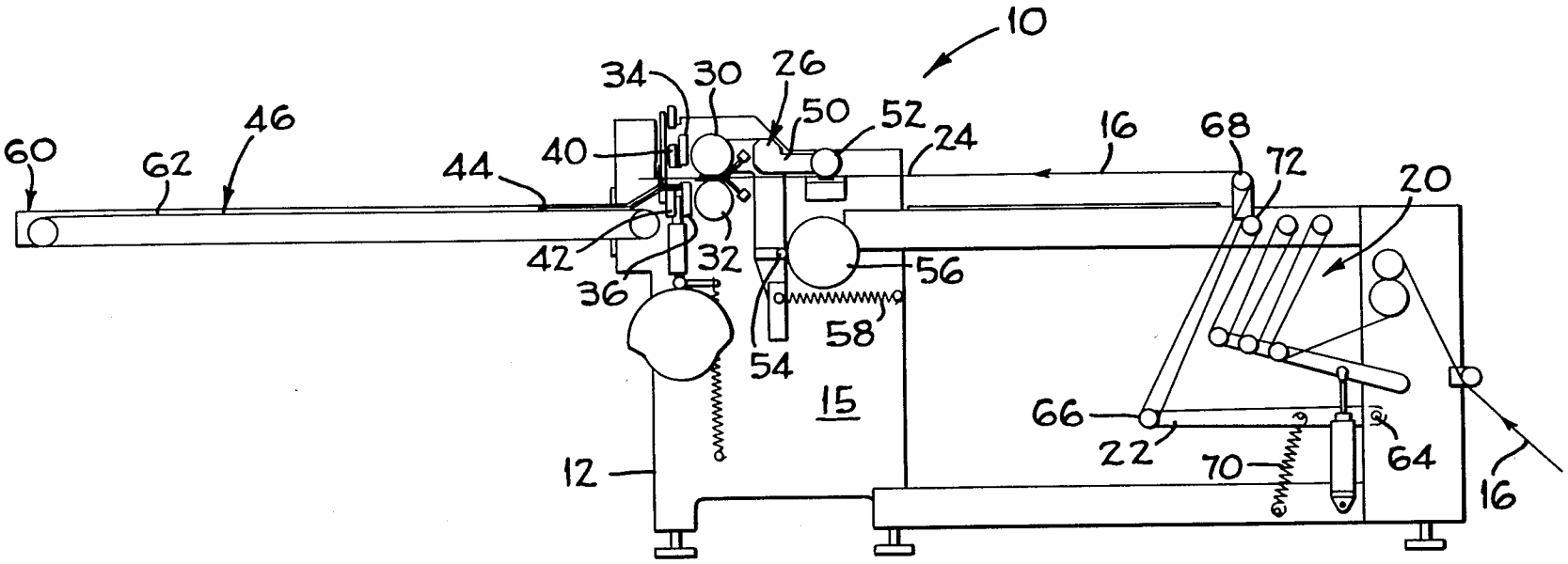
10
12
15
16
16
20
22
24
26
30
32
34
36
40
42
44
46
50
52
54
56
58
60
62
64
66
68
70
72

BAG MAKING MACHINE

This invention is related to the bag making machine disclosed in U.S. patent application, Ser. No. 07/039,055 filed on Apr. 16, 1987, pending, entitled Bottom Seal Bag Making Machine and to U.S. patent application, Ser. No. 07/039,043 filed on Apr. 16, 1987, now U.S. Pat. No. 4,764,160 of Aug. 16, 1988, entitled Bottom Seal Bag Making Machine.

Both applications are related to the bottom seal bag making machine disclosed in U.S. patent application Ser. No. 06/941,879, filed on Dec. 15, 1986, now U.S. Pat. No. 4,726,803 of Feb. 23, 1988, and are herein incorporated by reference.

The present invention relates to a machine for the manufacture and stacking of bags, pouches and the like made from a sheath or a web of flattened tubular thermoplastic material. The thermoplastic material is provided to the bag forming portion of the machine from a roll of thermoplastic material carried in on an unwinder. The unwinder is provided with a multiple roll dancer and a single roll dancer through which the thermoplastic material is fed prior to bag formation. The bag forming portion of the machine comprises a guiding path for transporting the web of a flattened thermoplastic material to a set of two intermittently driven upper and lower transporting rollers between which the flattened web is tightly held during intermittent transport movement thereby. The lower roller of which is mounted in a fixed in place manner and the upper roller of which is mounted for vertical movement so that it can move vertically away from the fixed in place roller under the action of a first governing member. A set of upper and lower welding jaws are positioned on opposite sides of the intermittent trajectory path of the web moving downstream from the two transporting rollers, at least one of two welding jaws is vertically movable perpendicularly to the trajectory path so that it can approach and move away from the other welding jaw. A transverse web cutting device is provided downstream from the welding jaws and comprises an upper knife or blade and a lower counter-blade, as well as a device for the intermittent stopping of the web. The stopping device is provided upstream from the two welding jaws, and upstream from the transporting roller means and comprises a movable upper support shoe which is activated by the first governing member, and a fixed in place lower counter-shoe.

According to a known mode of operation of the stacking device, after cutting the last cut bag, the bottom sealed end portion of which now rests on a stack of prior formed bags stacked in a pile on a stacking table, the stack of bags is moved downwardly under a action of the blocking shoe, or the lower jaw is slightly raised in order to separate the stack from a retaining shoulder on the lower jaw. This permits the rear or upstream top open end of the cut bag to be flattened and to place itself on the pile of bags below the shoulder where it will be maintained, for example, as soon as the blocking shoe goes back up and the lower jaw moves down, thus making possible, under the action of a return spring, the rising again of the stacking table and the clamping of the upstream top open end of the pile of bags between the table and the retaining shoulder of the lower welding jaw.

The specific operation of the bag making machine is fully disclosed in the above identified applications which have been and are incorporated herein and in the related application, Ser. No. 06/941,879, now U.S. Pat. No. 4,726,803.

Other characteristics and advantages of the present invention will be seen in the following description of an exemplary embodiment of the invention to be read in connection with the sole FIGURE, in which:

FIG. 1 is a side elevation view of a bag making machine and a combination of a first dancer having multiple rolls and a second dancer having a single roll interposed between constant and intermittent web feed sections of the bag making machine.

With reference to FIG. 1, the bag production machine designated 10 comprises a frame 12 having side plates 15. A thermoplastic web 16 which is unwound by the rollers 11 on the constant web feed section of the bag making machine from an unwind station (not shown) with the web 16 moving through a series of rollers, including a dancer arm and multiple roll unit 20 and a single roll and dancer arm unit 22 and along a guiding path 24, extending through the upper portion of the bag forming machine.

Along the trajectory of the web on the guiding path there are provided for, from the frontal upstream end to rearward downstream end, a photoelectric cell arranged to detect the length markings on web 16 and to start the activation of a governing member, an intermittent stopping device 26 for intermittently stopping the travel of the web 16 downstream to two cooperating transporting roller means 30, 32, for moving the web 16 forward by a given length to two cooperating welding jaw means 34, 36 for welding or sealing together the two opposite horizontal facing surfaces of the flattened web 16 along a transverse extending weld line and, preferably, perpendicular to the longitudinal extending sides of the flattened web 16, a transverse extending cutting device means 40 for cutting the top end of a previously bottom welded bag segment moved 16 downstream and in the immediate proximity of the welding joint made in the successive bag segment; by the jaw means 34, 36, a stacking device means 42 for stacking the bottom welded and cut top ends of the formed bags 44 thereon, and a transporting belt means 46 for transporting a completed stack of bags from the stacking device means to an accumulating area.

The lower transporting roller 32 on the intermittent web feed section of the bag making machine is fastened to a drive, not shown, which is connected to a continuous driving motor, not shown, through a speed variation device, also not shown.

The upper transporting roller 30 is fastened by means, to a free end of rock arm lever which extends downstream from the elbow 50, which is mounted for pivoting around a pivot shaft fixed in place to the frame 12. The horizontal arm of the double arm rock lever 50 carries the support shaft for the upper roller 52, while the depending vertical arm of the double arm lever carries in close proximity to the lower free end, a small disk or roller 54 which cooperates with a cam 56 which constitutes, for the upper roller 52, a first governing member. The stopping device 26 is fastened in place to frame 12.

The lower end of the depending vertical rock arm of the double arm crank lever 50 is connected to a return tension spring 58.

So as to be able to ensure the precise stopping of the web 16 at the end of each one bag length forward motion step, the machine is also equipped with an intermittent stopping means 26 on the intermittent web feed section of the bag making machine which comprises a simple lever arm having a downstream projecting end on the terminal end of the horizontal rock arm 50 of double arm lever.

Immediately downstream, from the pair of transporting rollers 30, 32, there is provided two cooperating welding jaws 24, 26. As disclosed in the aformentioned application, Ser. No. 07/039,043 lower jaw 36 is vertically movable over a short distance and the upper jaw 34 is vertically movable over a greater distance.

The cutting device 40, is mounted downstream and in the immediate proximity of the upper jaw 34 and comprises a pair of timing belt drive and return pulleys, as disclosed in the aforementioned application, Ser. No. 07/039,055, around which runs an endless timing support belt. At least one of the two sides of the belt, preferable the lower side, is guided in a horizontal transverse direction parallel to the horizontal transverse groove in the shoulder on the lower jaw 36, by means of a small transverse guiding channel or grooved bar.

Below and downstream from the lower welding jaw 36, as disclosed in the aforementioned related application, Ser. No. 06/941,879, now U.S. Pat. No. 4,726,803, there is a stacking device comprising a stacking table generally 60 having an upstream side which extends horizontally below the retaining shoulder and a downstream side with an endless transport belt conveyor 62.

The invention set forth herein includes a single roll dancer 22 that is pivotally supported at 64 to each side of the frame 12 at the constant web feed section of the bag mixing machine. The dancer arms, one on each side of the machine, extend toward the intermittent web feed section at bag making portion of the machine a distance greater than the length of the dancer arms of the dancer arm and multiple roll unit 20. The dancer arms 22 support a transverse roll 66 upon which the thermoplastic film is threaded before the film changes direction at an idler roller 68 fixed in place on top of the frame 12.

The single roll dancer is equipped with a spring 70, grounded to the machine, that urges the dancer to keep the fabric taut between rolls 72 and 68. The spring 70 can also be an alternative pressure supplying device, such as an air cylinder or a biased hydraulic cylinder.

Alternatively, it is contemplated that the dancer 22 can be a dancer with two or more transverse rolls similar to 66. In this alternate embodiment, the machine would have can be a dancer and multiple-roll 20 and a second dancer and multiple-roll unit in the location of the single roll and dancer unit 22.

The operation of the bottom seal bag making machine is well known in the art so that no elaborate and detailed description was given above. Certain modifications may be made in the described practice of the invention without departing from the scope of the protection defined by the attached claims.

What is claimed is:

1. In a bag making machine having an upstream constant web feed section and a downstream intermittent web feed section defined by the path of a web moving therethrough, a combination of a first dancer having dancer arms supporting multiple rolls along the web path downstream of the constant web feed section and a second dancer having at least one roll, wherein the improvement comprises:

the second dancer having a pair of arms each pivotally mounted at one end adjacent the constant web feed section of the bag making machine and each having a swingable end carrying the one roll therebetween and extending a distance greater than the length of the dancer arms of the first dancer in a direction toward the intermittent web feed section of the bag making machine, the one roll positioned below and along the web path downstream of the first dancer having the multiple rolls, means for resiliently urging the swingable ends of the arms downwardly away from the first dancer, and at least one idler roll interposed along the web path between the one roll and the intermittent web feed section for directing the web in a horizontal path to the intermittent web feed section of the bag machine.

* * * * *